US006048156A

United States Patent [19]

Huang

[11] Patent Number: 6,048,156

[45] Date of Patent: Apr. 11, 2000

[54] VEHICLE PARKING DEVICE

[76] Inventor: Bosen Huang, No. 12-15, Lane 26, Sec. 1., Chung-Shing Rd., Ta-Li City, Taichung Hsien, Taiwan

[21] Appl. No.: 09/128,380

[22] Filed: Aug. 3, 1998

[51] Int. Cl.[7] ..... E04H 6/06

[52] U.S. Cl. ..... 414/234; 414/228

[58] Field of Search ..... 187/251, 256; 414/228, 233, 234, 227, 231, 236, 240, 242, 243, 244, 245, 246, 247, 248, 249, 251, 252, 261; 254/4 R, 4 B, 4 C

[56] References Cited

FOREIGN PATENT DOCUMENTS

| | | | |
|---|---|---|---|
| 2681893 | 4/1993 | France | 414/228 |
| 53-85076 | 7/1978 | Japan | 414/234 |
| 1-278664 | 11/1989 | Japan | 414/233 |
| 5-93470 | 4/1993 | Japan | 414/228 |

*Primary Examiner*—Frank E. Werner
*Attorney, Agent, or Firm*—Welsh & Katz, Ltd.

[57] ABSTRACT

A vehicle parking device includes a base with four posts extending therefrom and every two adjacent of the posts have two rails connected therebetween on which three first parking units are moved. Each of the posts has a first sprocket mounted thereto and two first parking units movable on the rails and three second parking units movably located between any two adjacent posts. Each of the second parking units has two sprockets mounted to the rear end thereof so that a cable, which has one end thereof fixedly connected to one of two outermost post and the other end thereof engaged with a motor mounted to the other outermost post, reeved through the first sprockets and the second sprockets such that each of the second parking units are moved vertically between the two posts corresponding thereto.

7 Claims, 7 Drawing Sheets

VEHICLE PARKING DEVICE

FIELD OF THE INVENTION

The present invention relates to a parking device, and more particularly, to a vehicle parking device having an upper section and a lower section and each of the two sections having a plurality of parking units which are movably driven by cables and a motor so as to be shifted horizontally and vertically.

BACKGROUND OF THE INVENTION

Parking devices are necessary for metropolitan areas because there are so many vehicles but limited parking spaces. Parking towers were developed to meet the needs. However, such conventional parking towers generally have complicated structures and high manufacturing cost so that few people are willing to invest their money in manufacturing the parking towers. In other words, the conventional parking lots include a plurality of parking units which have their own driving mechanism and can be operated independently. Accordingly, many motors, cables, sensors etc. are needed. This could make a lot of money if there are enough parking units most of which are used frequently. On the contrary, if the conventional parking device is made in a small scale and is not used for commercial purpose, too many motors, cables, sensors etc. will become a burden to the owner(s).

The present invention has arisen to mitigate and/or obviate the disadvantages of the conventional parking device.

SUMMARY OF THE INVENTION

In accordance with one aspect of the present invention, a parking device is provided and comprises a base having two base frames with a connecting rod and two rails respectively connected between the two base frames. At least three posts extend from the connecting rod at equal intervals and each of the posts has a first sprocket mounted to the top thereof. A first parking unit is respectively and movably located between two of the adjacent posts and has a platform which is movable along the two rails.

At least two second parking units each are located between any two of the adjacent posts and have a platform. Each of the second parking units has two second sprockets and two roller means respectively mounted to the rear end thereof. Each of the roller means is movably mounted along the post corresponding thereto. A cable fixture is fixedly connected to the outermost post on one end of the parking device and a motor is fixedly connected to the other outermost post on the other end of the parking device. A cable has a first end thereof fixedly attached to the cable fixture and a second end thereof retractably engaged with the motor. The cable is reeved through the first sprockets and the second sprockets in sequence.

An object of the present invention is to provide a vehicle parking device with a simple structure.

Another object of the present invention is to provide a vehicle parking device having a plurality of upper parking units which can be moved vertically and lower parking units which can be moved horizontally.

Further objects, advantages, and features of the present invention will become apparent from the following detailed description with appropriate reference to the accompanying drawings.

DETAILED DESCRIPTION OF THE PREFERRED EMBODIMENT

Figure 1:
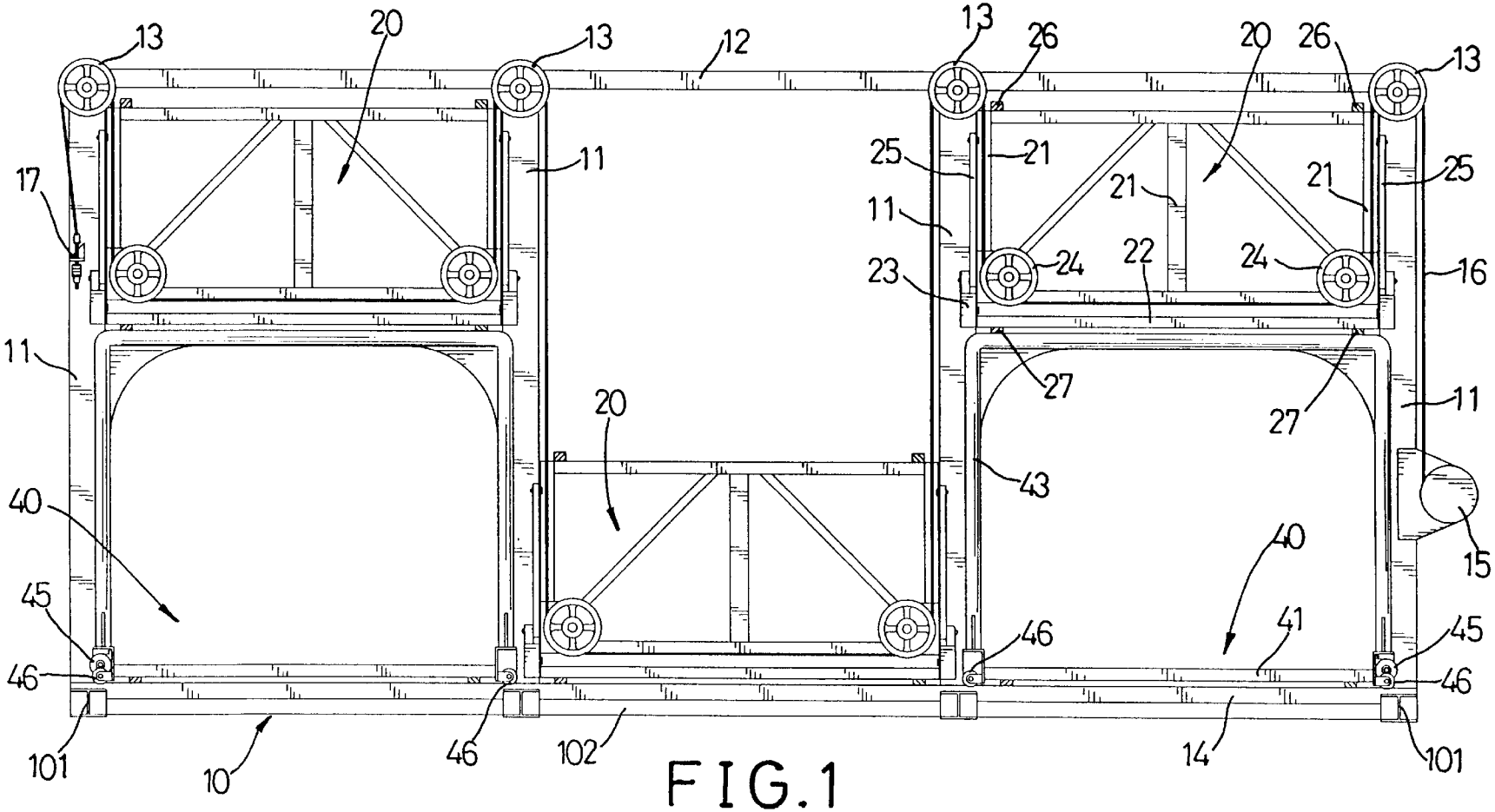
FIG. 1 is a front view of the vehicle parking device in accordance with the present invention.

Referring to FIGS. 1 through 4, a parking device in accordance with the present invention comprises a base 10 having four base frames 101 to be put on the ground and a connecting rod 102 connected between the four base frames 101. Two rails 14 are connected between the four base frames 101 and four posts 11 extend from the connecting rod 102 at equal intervals. A beam 12 is connected between the four respective top ends of the four posts 11. Each of the adjacent two posts 11 has an operation space defined therebetween. Each of the posts 11 is an H-shaped steel beam and has a first sprocket 13 mounted to a top thereof. The two posts 11 except the two outermost posts 11 each have two flanges 18 extending from two opposite sides thereof and the two outermost posts 11 each have a flange 18 extending from an inner side thereof.

Two first parking units 40 are respectively and movably located in two of the three spaces, that is to say, between either two of the adjacent posts 11. The two first parking units 40 can only occupy two of three operation spaces defined between the four posts 11. Each of the first parking units 40 has a platform 41 on which a car can be parked and two motors 45 are mounted to the platform 41 with two sets of rollers 46 mounted to the bottom of the platform 41 so as to be actuated by the motors 45 and roll along the two rails 14. Therefore, the two first parking units 40 can be shifted between the three operation spaces when needed. An inverted U-shaped frame 43 is mounted to the platform 41 of each of the first parking units 40 and each of the inverted U-shaped frames 43 has two damper members 27 attached to the top thereof.

Figure 2:
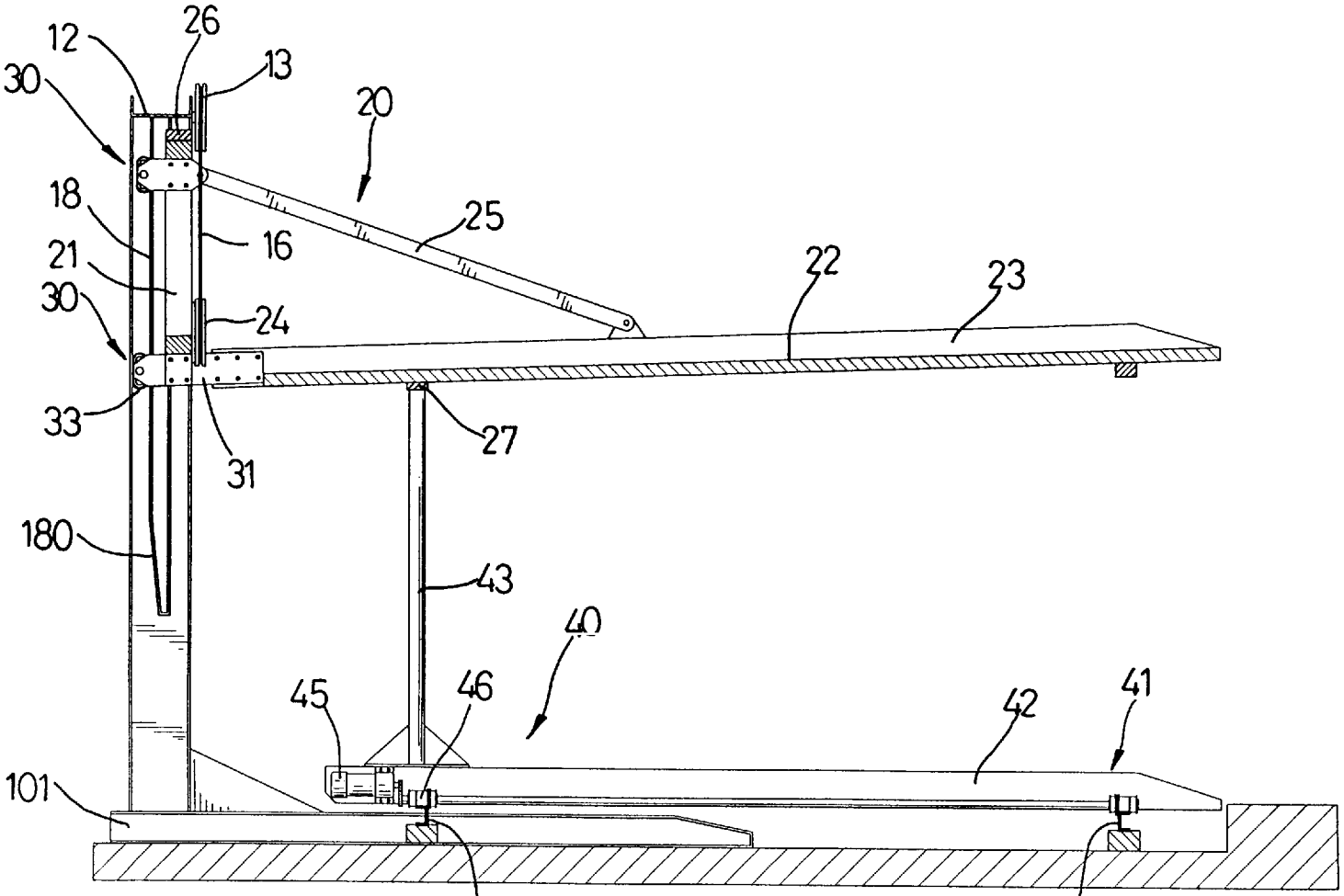
FIG. 2 is a side elevational view, partly in section, of the vehicle parking device in accordance with the present invention.
Figure 3:
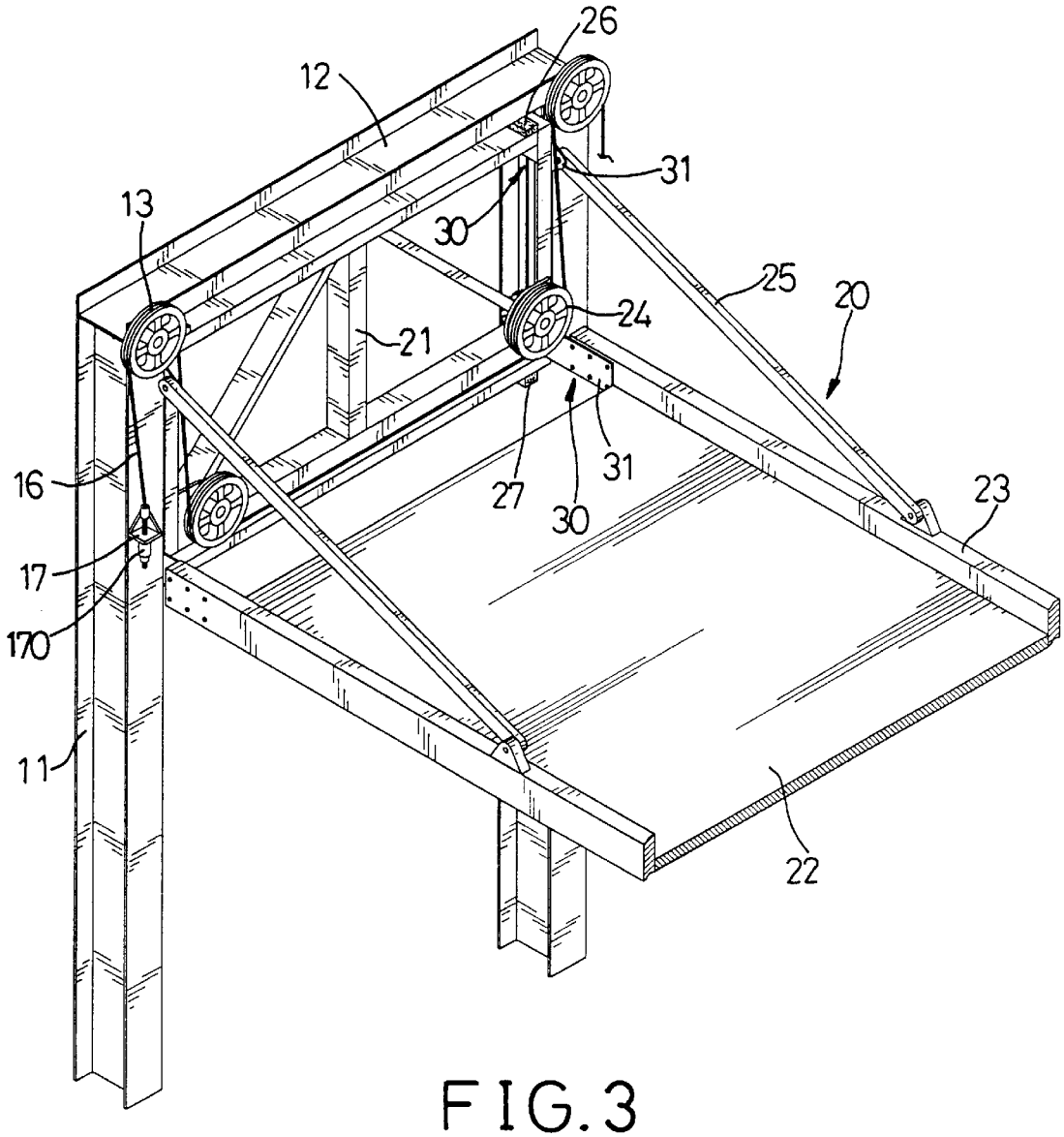
FIG. 3 is a perspective view of one of the second parking units in accordance with the present invention.
Figure 4:
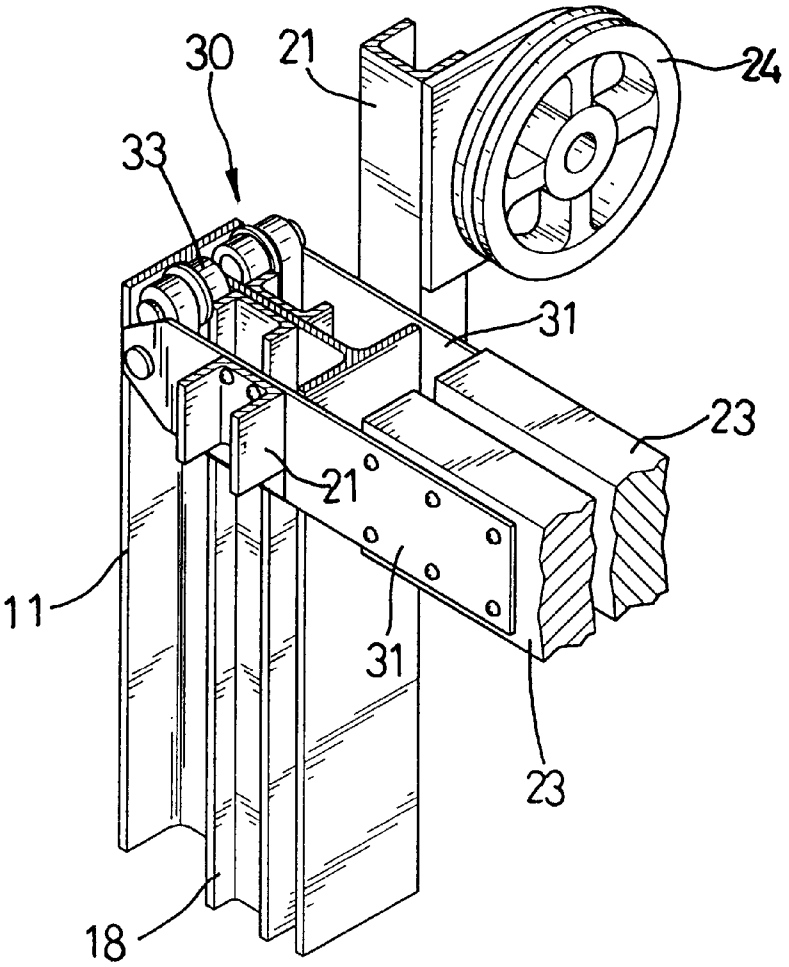
FIG. 4 is a perspective view to show the roller means of the vehicle parking device in accordance with the present invention.

Three second parking units 20 are respectively located in the upper portions of the three operation spaces between the four posts 11, that is to say, between any two of the adjacent posts 11. Each of the second parking units 20 is a platform 22 on which a car can be parked and two second sprockets 24 and two roller means 30 are respectively mounted to the rear end of each of the second parking units 20. Each of the roller means 30 is able to be movably mounted along the post 11 corresponding thereto. Each of the roller means 30 has a connecting plate 31 which has a first end thereof fixedly connected to the platform 22 of the second parking unit 20 corresponding thereto and a second end thereof with two rollers 33 mounted thereto (FIG. 2). Each of the posts 11 has two flanges 18 extending laterally from two opposite sides thereof on which the rollers 33 corresponding to the flange 18 moves. Each of the flanges 18 has an inclined surface 180 defined in the lower section thereof. Each of the three second parking units 20 has a back frame 21 extending from the rear end thereof and two supporting plates 25 are respectively connected between the back frame 21 and the two side flanges 23 of the platform 22 thereof. Each back frame 21 has another two damping members 26 attached to the top thereof.

A cable fixture 17 is fixedly connected to an outermost post 11 on one end of the parking device and a motor 15 is fixedly connected to the other outermost post 11 on the other end of the parking device. A cable 16 has a first end thereof fixedly attached to the cable fixture 17 and a second end thereof retractably engaged with the motor 15. The cable fixture 17 has a tension adjusting knob 170 so as to adjust the cable 16. The cable 16 is reeved through the first sprockets 13 and the second sprockets 24 in sequence from the end having the cable fixture 17 to the other end of the parking device.

Figure 5:
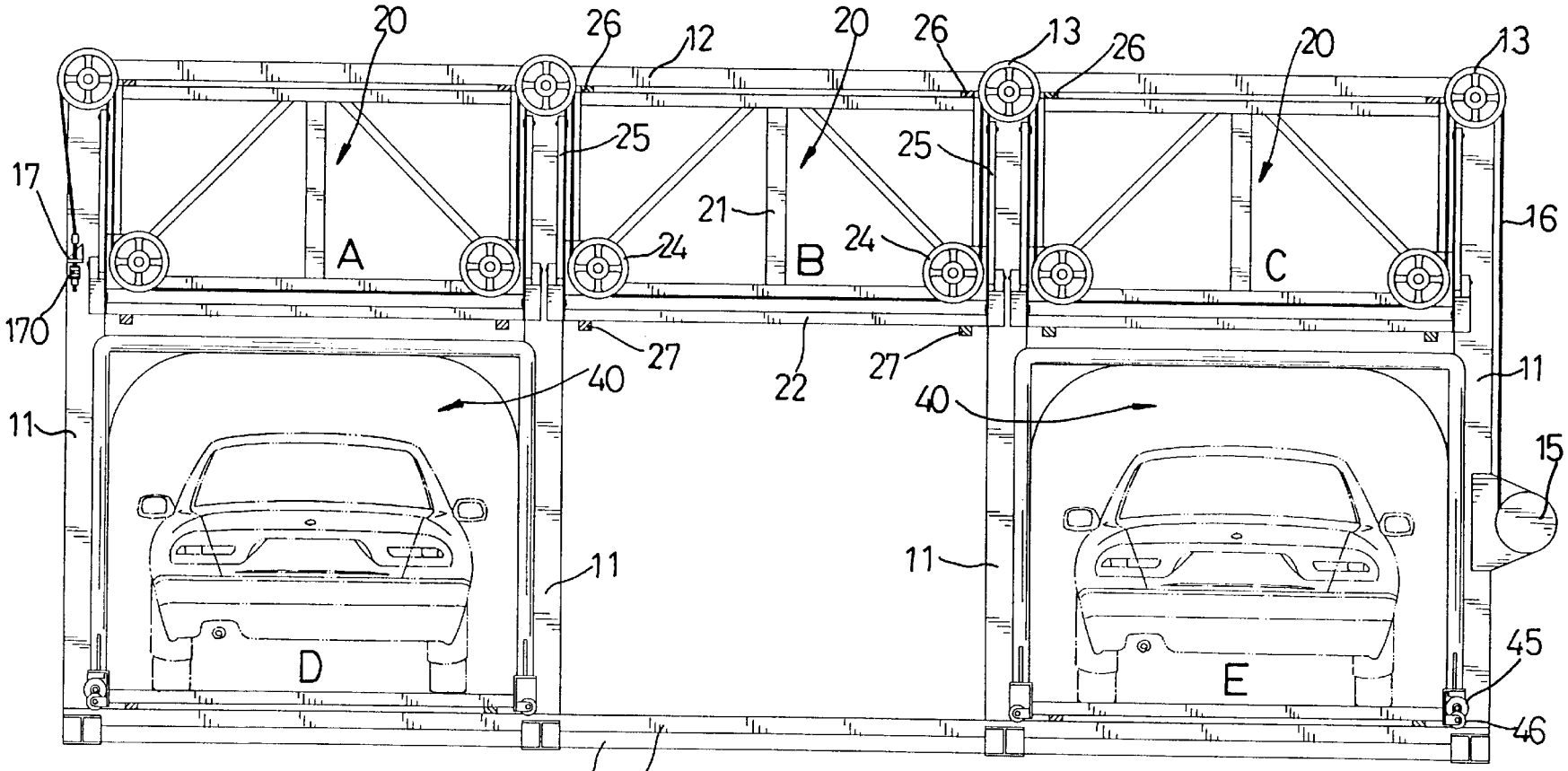
FIG. 5 is a front view to show when all the second parking units are moved to the upper portion of the parking device of the present invention.
Figure 6:
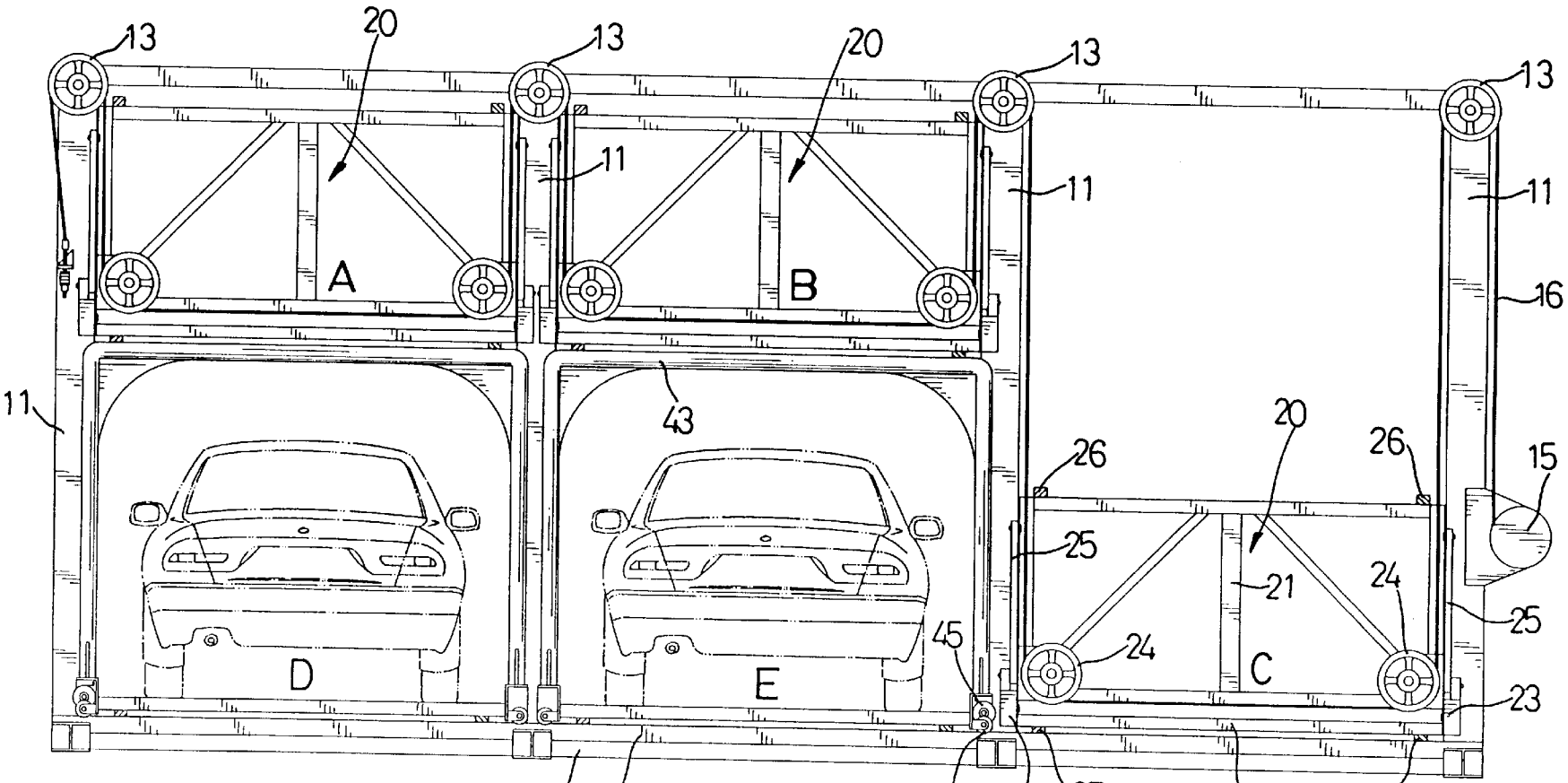
FIG. 6 is a front view to show one of the second parking units lowered.
Figure 7:
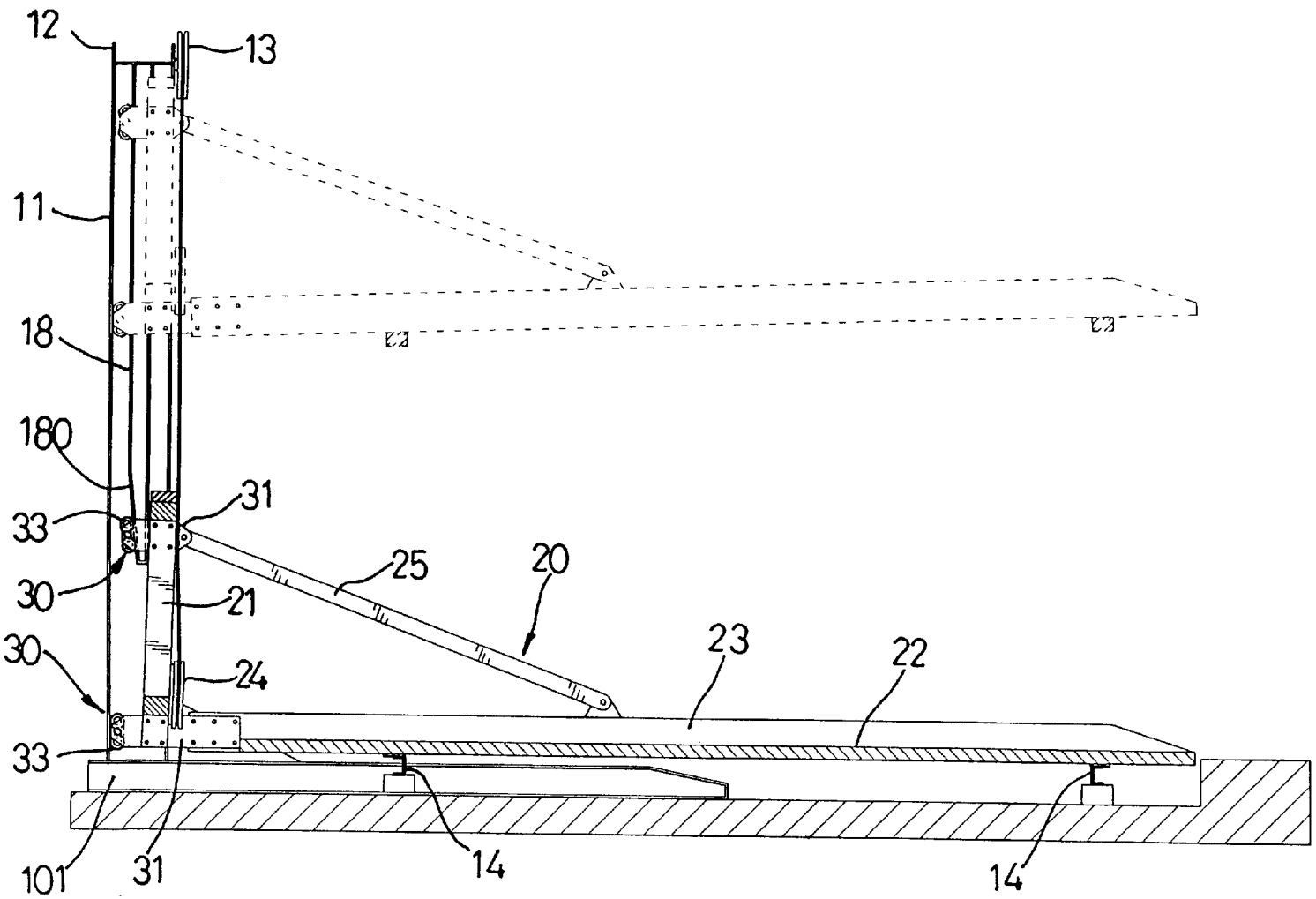
FIG. 7 is a side elevational view to illustrative how the second parking unit is lowered.

Therefore, the first parking units 40 can only be moved horizontally along the rails 14 and the second parking units 20 can only be moved vertically in the corresponding operation space. When one of the second parking units 20 is located above one of the first parking units 40, the platform 22 of the second parking unit 20 is supported on the damping members 27 on the U-shaped frames 43. Referring to FIGS. 5 through 7, the three second parking units 20 and the two first parking units 40, from left to right, are respectively labeled as unit A, unit B, unit C, unit D and unit E. In FIG. 5, units A, B and C are located in the upper portion of the respective operation spaces and unit D and E are located in the lower portion of the respective operation spaces wherein the operation space below unit B is empty. When units D and E respectively has a car parked therein and if a third car is to be parked in unit C, unit E is first moved to the empty operation space below unit B, and then loosening the cable 16 by operating the motor 15 to lower unit C to the position where unit E was located such that the car can be parked in unit C. When unit C is lowered, the rollers 33 roll along the inclined surface 180 which is inclined toward the front end thereof so that unit C will be shifted toward the front end of the device slightly when unit C is moved to the position where unit E was located as shown in FIG. 7.

Although the invention has been explained in relation to its preferred embodiment, it is to be understood that many other possible modifications and variations can be made without departing from the spirit and scope of the invention as hereinafter claimed.

What is claimed is:

1. A parking device comprising:

a base having two base frames and a connecting rod connected between said two base frames, two rails connected between said two base frames and at least three posts extending from said connecting rod at equal intervals, each of said posts having a first sprocket mounted to the top thereof;

a first parking unit located between either two of said adjacent posts, said first parking unit having a platform and movable along said two rails in a reciprocal lateral movement, a first motor mounted to said platform, at least one set of rollers attached to the bottom of said platform so as to be actuated by said first motor and roll along said two rails, and an inverted U-shaped frame attached to said platform;

at least two second parking units mounted for reciprocal vertical movement between any two of said adjacent posts, each of said second parking units having a platform, each of said second parking units having two second sprockets and two roller means respectively mounted to the rear end thereof; each of said roller means movably mounted along said post corresponding thereto, and a cable fixture fixedly connected to an outermost post on one end of said parking device and a second motor fixedly connected to the other outermost post on the other end of said parking device, a cable having a first end thereof fixedly attached to said cable fixture and a second end thereof retractably engaged with said second motor, said cable reeved through each said first sprockets and each of said second sprockets in sequence for driving said second parking units in said reciprocal vertical movement.

2. The parking device as claimed in claim 1, wherein said inverted U-shaped frame has at least one damper member attached to the top thereof.

3. The parking device as claimed in claim 1, wherein each of said roller means has a connecting plate which has a first end thereof fixedly connected to said platform of said second parking unit corresponding thereto and a second end thereof with a plurality of rollers mounted thereto which rolls along said post corresponding thereto.

4. The parking device as claimed in claim 3, wherein each of said posts has a flange extending therefrom on which said rollers correspond to said flange moves.

5. The parking device as claimed in claim 4, wherein each of said flanges has an inclined surface defined in the lower section thereof.

6. The parking device as claimed in claim 1, wherein each of said at least two second parking units has a back frame extending from the rear end thereof and two supporting plates respectively connected between said back frame and two sides of said platform thereof.

7. A parking device comprising:

a base having two base frames and a connecting horizontal rod connected between said two base frames, two rails connected between said two base frames and at least three vertical posts extending from said connecting rod at equal intervals, each of said posts having a first sprocket mounted to the top thereof;

a first parking unit located for reciprocal lateral movement along said two rails, said first parking unit having a platform;

at least two second parking units mounted for reciprocal vertical movement between any two of said adjacent posts, each of said second parking units having a platform, each of said second parking units having two second sprockets mounted to the rear end thereof; and a cable fixture fixedly connected to an outermost post on one end of said parking device and a second motor fixedly connected to the other outermost post on the other end of said parking device, a cable having a first end thereof fixedly attached to said cable fixture and a second end thereof retractably engaged with said motor, said cable reeved through each of said first sprockets and each of said second sprockets in sequence for driving said second parking units in said reciprocal vertical movement.

* * * * *